US006817826B2

(12) United States Patent
Bullington et al.

(10) Patent No.: US 6,817,826 B2
(45) Date of Patent: Nov. 16, 2004

(54) COIL HANDLING DEVICE

(75) Inventors: Robert E. Bullington, Lake Zurich, IL (US); Stanislaw Witczak, Norwood Park Township, IL (US); Bobby L. Goin, Florence, SC (US)

(73) Assignee: Illinois Tool Works, Inc., Glenview, IL (US)

( * ) Notice: Subject to any disclaimer, the term of this patent is extended or adjusted under 35 U.S.C. 154(b) by 88 days.

(21) Appl. No.: 10/228,643

(22) Filed: Aug. 27, 2002

(65) Prior Publication Data

US 2002/0197143 A1 Dec. 26, 2002

Related U.S. Application Data

(62) Division of application No. 09/866,257, filed on May 25, 2001, now Pat. No. 6,499,932.

(51) Int. Cl.[7] ..... B66F 9/18

(52) U.S. Cl. ..... 414/621; 414/684; 414/910; 414/911; 294/97

(58) Field of Search ..... 414/620, 621, 414/740, 908, 910, 911, 684; 294/94, 95, 97, 103.1, 103.2

(56) References Cited

U.S. PATENT DOCUMENTS

| | | | | |
|---|---|---|---|---|
| 2,624,609 A | * | 1/1953 | Storm | 294/86.4 |
| 2,706,658 A | | 4/1955 | Jewell | |
| 2,817,450 A | | 12/1957 | Ulinski | |
| 2,823,948 A | | 2/1958 | Horton | |
| 2,951,725 A | | 9/1960 | St. Jean | |
| 3,044,647 A | | 7/1962 | Hopfeld | |
| 3,409,156 A | | 11/1968 | Mills | |
| 4,029,230 A | | 6/1977 | Bolduc et al. | |
| 4,121,868 A | * | 10/1978 | Pierce et al. | 294/116 |
| 4,460,210 A | | 7/1984 | Miechur | |
| 4,515,522 A | | 5/1985 | Sonerud | |
| 4,531,771 A | | 7/1985 | Bullock | |
| 4,557,515 A | * | 12/1985 | Read | 294/67.22 |
| 5,642,979 A | | 7/1997 | Cullen et al. | |
| 5,934,865 A | * | 8/1999 | Meadows | 414/796.9 |
| 6,276,628 B1 | | 8/2001 | Focke et al. | |
| 6,499,932 B2 | * | 12/2002 | Bullington et al. | 414/620 |
| 2002/0054811 A1 | | 5/2002 | Lofgren | |

FOREIGN PATENT DOCUMENTS

| | | |
|---|---|---|
| WO | 93/09054 | 5/1993 |

* cited by examiner

*Primary Examiner*—James W. Keenan
(74) *Attorney, Agent, or Firm*—Mark W. Croll, Esq.; Donald J. Breh, Esq.; Welsh & Katz, Ltd.

(57) ABSTRACT

A coil handling device for engaging a coil having a depth and an interior surface defining a diameter and defining a longitudinal axis, is configured to engage the coil with the longitudinal axis oriented vertically and reorient the coil to position the longitudinal axis horizontally. The handling device includes a transport assembly, a lift assembly and a manipulating assembly. The manipulating assembly is mounted to the lift assembly and includes a pair of spaced apart support arms and a pivoting carriage carried by the support arms. The carriage includes a locking arm for engaging the interior surface of the coil along the depth of the coil and a thrust lever including a bearing arm and a lever arm disposed at an obtuse angle to one another opposite the locking arm. The thrust lever is being pivotably mounted to the carriage between a first position wherein the locking arm and bearing arm readily insert into the coil and a second position wherein the bearing arm is urged against the interior surface of the coil to lock the coil between the locking arm and the bearing arm. The pivoting carriage is pivotable between a first position in which the coil longitudinal axis is vertical and a second position in which coil longitudinal axis is horizontal.

9 Claims, 4 Drawing Sheets

COIL HANDLING DEVICE

CROSS REFERENCE TO RELATED APPLICATION DATA

This application is a divisional application of U.S. patent application Ser. No. 09/866,257, filed May 25, 2001, now U.S. Pat. No. 6,499,932.

BACKGROUND OF THE INVENTION

This invention pertains to a coil handling device. More particularly, the invention pertains to a coil manipulating and transporting device for lifting and rotating coiled materials.

Many materials are supplied in coiled form. For example, strapping material, such as plastic or steel strap is often supplied in coiled form on, for example, a spool or spindle.

In handling coiled strapping material, most strapping machines require that the coils be positioned on the machine with the longitudinal axis of the coil in a horizontal orientation. That is, the coils are mounted to the machine so that the material feeds from a top or bottom of the coil and so that the coiled material can rotate around a spindle or axis positioned in a horizontal orientation.

Coiled strapping material is often quite heavy and can be bulky, vis-à-vis storage and handling. As such, it is desirable to package, store and ship the material in the same orientation in which it is placed on a strapping machine. This readily facilitates handling and transport of the spools from any shipping pallet or container to the strapping machine.

One drawback to shipping the coiled material in this fashion is that the coils can only be shipped or packaged in a single layer. That is, because the coils are resting on a periphery of the coil, only one layer of coils is practicable. That is, it is impracticable, if not impossible to stack coils one on top of another when the coils are resting on the coil periphery.

Accordingly, there exists a need for a coil handling device that permits shipping and storage of coils in a more efficient, e.g., stackable, manner. Desirably, such a device permits handling of a coil shipped with the longitudinal axis vertically oriented. Most desirably, such a device facilitates engaging an individual coil and manipulating that coil to position (the longitudinal axis) it from a vertical orientation to a horizontal orientation. Still more desirably, such a device readily separates stacked coils from one another, manipulates the coils to reorient the longitudinal axis and is used to transport the coils from one location to another to, for example, load a coil of strapping material onto a strapping machine.

BRIEF SUMMARY OF THE INVENTION

A coil handling device engages a coil having a depth and an interior surface that define a diameter and a longitudinal axis, and is configured to lock the coil thereon with the longitudinal axis oriented vertically and reorient the coil to position the longitudinal axis horizontally. The device permits handling of coils that are shipped and stored in a stacked orientation and facilitates engaging an individual coil and manipulating that coil to position the longitudinal axis from a vertical orientation to a horizontal orientation for placement on a strapping machine.

The handling device includes a transport assembly including a base and a plurality of casters, a lift assembly mounted to the base that includes a drive and is configured to lift a load carried thereby, and a manipulating assembly.

The manipulating assembly is mounted to the lift assembly. The manipulating assembly includes a pair of spaced apart support arms and a pivoting carriage carried by the support arms. The carriage includes a locking arm for engaging the interior surface of the coil along the depth of the coil and a thrust lever positioned opposite the locking arm.

The thrust lever includes a bearing arm and a lever arm disposed at an obtuse angle to one another. The thrust lever is mounted to the carriage for pivotal movement between a first position in which the locking arm and bearing arm readily insert into the coil and a second position in which the bearing arm is urged against the interior surface of the coil to lock the coil between the locking arm and the bearing arm.

The carriage pivots between a first position in which the coil longitudinal axis is vertical and a second position in which coil longitudinal axis is horizontal.

In a current embodiment, the carriage includes a pair of transverse support members that have pivot members at ends thereof for pivoting the carriage. The carriage further includes first and second flange arms extending transverse to the transverse support members. The locking arm is mounted to the first flange arm and the thrust lever is mounted to the second the flange arm.

A positioning member can extend from the first flange arm, opposite the locking arm. The thrust lever can cooperate with the positioning member to lock the thrust arm when the bearing arm is urged against the interior surface of the coil to lock the coil between the locking arm and the bearing arm and to lock the thrust arm at a predetermined position for inserting the bearing arm and locking arm into the coil. The positioning member can be further configured having a lift lock configured to cooperate with a lock on the lift assembly to secure the coil to the handling device when the pivoting carriage is pivoted to position the coil longitudinal axis horizontal To facilitate locking the coil to the carriage, a hook-like projection can extend from an end of the locking arm. The hook-like projection can be removably attached to the carriage for engage the coil at juncture of the coil interior surface and a bottom surface of the coil. The locking arm can be fabricated in various sizes to accommodate coils of different depths.

In one embodiment, the transport assembly base includes a pair of angled caster supports extending therefrom. The angled caster supports define an open region therebetween. In this arrangement, the manipulating assembly is readily disposed above a coil that is on a pallet having multiple layers of four coils per layer, for lifting any of the coils from the pallet.

Alternate embodiments of the carriage include a camming element and a lever arm operably connected thereto for moving the camming element. Preferably, the camming element is formed as a rotating camming drum, and the lever arm is formed as a handle for rotating the camming drum. The camming drum is movable by movement of the handle between a first position in which the locking arm and camming drum insert onto the coil and a second position in which the camming element is urged against the coil to lock the coil between the locking arm and the camming drum.

The locking arm can be configured to engage an interior surface of the coil and the camming element can bear against an inner surface of the coil opposite the locking arm. Alternately still, the locking arm can engage an outer surface of the coil and the camming element can engage an the interior surface of the coil radially inward of the locking arm. The locking arm can include an elongated upper support portion that extends along the upper surface of the coil to support the coil.

The coil the locking arm can further be configured for engaging the interior surface of the coil when the camming element engages the outer surface of the coil.

For lesser depth coils, the device can include a flange arm. The locking arm and the camming element can be mounted to the flange arm. A second locking arm can engage the interior surface of the coil when the camming element bears against an interior surface of the coil opposite of the locking arm, and when the second locking arm engages the outer surface of the coil opposite the camming element.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
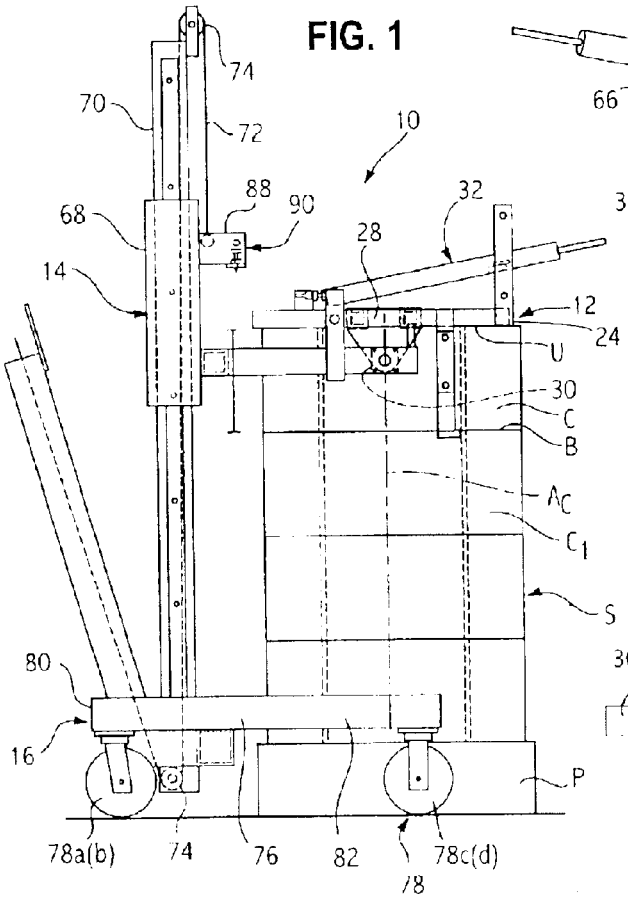
FIG. 1 is a side view of a coil handling device embodying the principles of the present invention, the device being illustrated atop a stack of four coils, and shown prior to engaging or locking the coils thereto.
Figure 3:
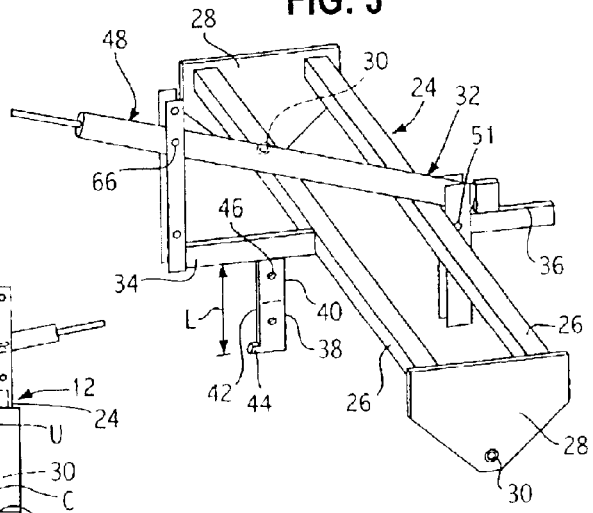
FIG. 3 is a perspective view of a coil manipulating assembly, the manipulating assembly being shown in a reversed perspective from that illustrate in FIGS. 1–2 and the components shown in FIGS. 4–7, described below.
Figure 4:
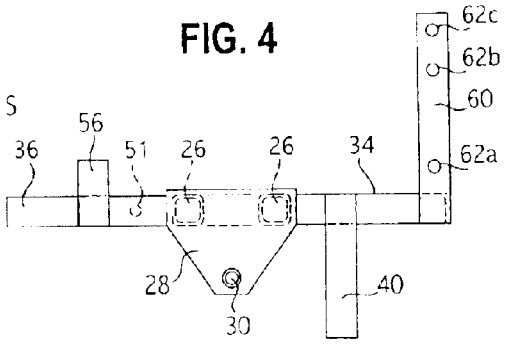
FIG. 4 is a side view of the carriage portion of the manipulating assembly of FIG. 3.
Figure 5:
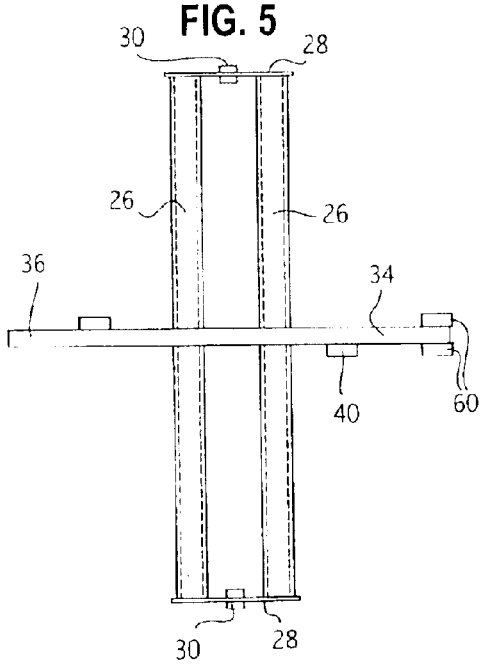
FIG. 5 is a top view of the carriage of FIG. 4.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated. It should be further understood that the title of this section of this specification, namely, "Detailed Description Of The Invention", relates to a requirement of the United States Patent Office, and does not imply, nor should be inferred to limit the subject matter disclosed herein.

Figure 2:
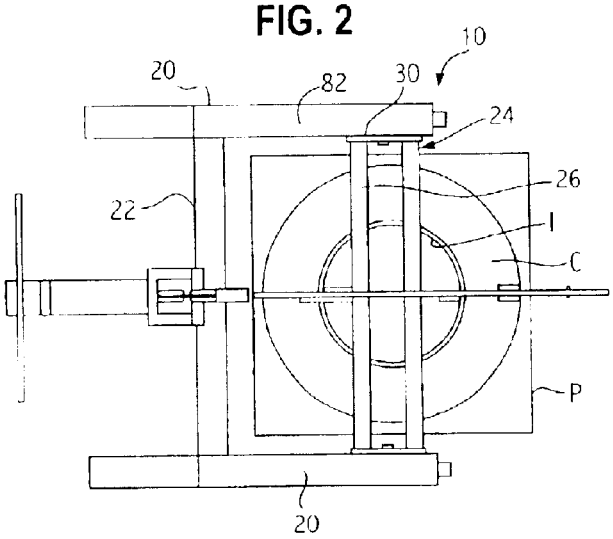
FIG. 2 is a top view of the coil handling device of FIG. 1.
Figure 6:
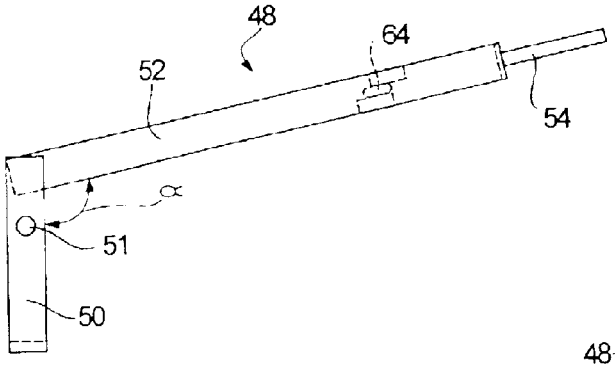
FIG. 6 is a side view of the thrust lever of the manipulating assembly of FIG. 3.
Figure 7:
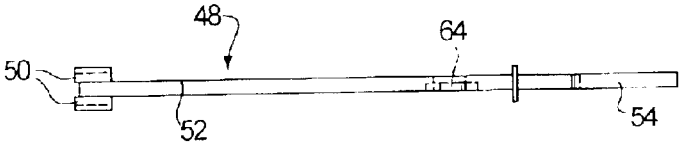
FIG. 7 is a top view of the thrust lever of FIG. 6.

Referring now to the figures and in particular to FIGS. 1–2, there is shown a coil handling device 10 embodying the principles of the present invention. The coil handling device 10 includes generally a manipulating assembly 12, a lifting assembly 14 and a transport assembly 16. Although these assemblies 12, 14, 16 may be separate or may integrated with one another into a single device, for ease of discussion and clarity, they will be addressed separately, in seriatim.

The manipulating assembly 12 is configured to engage a coil C of material that is oriented with its longitudinal axis $A_c$ vertical, separate the coil C of material from a coil $C_1$ below it on which it may be stacked, secure the coil C to the device 10 and to rotate the coiled material C to position the longitudinal axis $A_c$ in a horizontal orientation. For purposes of the present disclosure, when reference is made to horizontal and vertical coils, it is to be understood that this reference is to a longitudinal axis $A_c$ of the coil C. Thus, a vertical coil or a vertically oriented coil is one in which the coil is laying flat on a side, and a horizontal or horizontally oriented coil is one in which the coil is resting on a periphery of the coil.

The lifting assembly 14 is configured to cooperate with the manipulating assembly 12 to lift the coiled C material from a coil $C_1$ on which it may be stacked and elevate the secured coil C. The transport assembly 16 likewise cooperates with the manipulating assembly 12 and lifting assembly 14 to transport the coiled C material (which may be in either the horizontal or vertical orientation) and to move that coil C of material from one location to another.

Referring now to FIGS. 2–7, the manipulating assembly 12 includes a support portion 18 having a pair of longitudinally extending support arms 20. The arms 20 can be connected to one another at a central support member 22.

A pivoting carriage 24 is carried by the support arms 20. The carriage 24 includes at least one and preferably a pair of transverse members 26 that extend between the support arms 20. In a current embodiment, the transverse support members 26 are steel tubes. Pivot plates 28 are attached to opposing ends of the transverse carriage members 26 and are connected to respective support arms 20 at pivot locations, as indicated at 30. In a present embodiment, the pivot locations 30 are positioned below the transverse carriage members 26 (when the coil C is engaged or vertical) and each pivot plate 28 has a generally upside down triangular shape. The lower elevation of the pivot 30 facilitates pivoting the carriage 24 when a coil C is loaded thereon.

The carriage 24 further includes a locking assembly, indicated generally at 32. The locking assembly 32 is configured to engage a coil C, move the coil C from a stacked arrangement S (FIG. 1) and lock the coil C to the manipulating assembly 12. The locking assembly 32 includes first and second flange arms 34, 36, respectively, that are opposingly mounted to the transverse support members 26. The flange arms 34, 36 are configured such that they rest on the uppermost surface U of the coil C (when vertical), when the locking assembly 32 engages the coil C. In a current embodiment, the flange arms 34, 36 are steel bars that are affixed to the tubular transverse members 26 by, for example, welding.

A depending locking arm 38 is mounted to a stub 40 and extends from the first flange arm 34. The locking arm 38 includes an engaging surface 42 and a hook-like projection 44 extending transverse to the engaging surface 42 at the bottom of the arm 38. The engaging surface 42 is configured for engaging in an inner surface I of the coil C. The hook-like projection 44 is configured to engage the bottom B of the coil C at the coil/inner surface juncture.

In a current embodiment, the locking arm 38 is removably mounted to the stub 40 by, for example, fasteners, such as the exemplary bolts 46. The stub 40 is a steel bar that is mounted to the flange arm 34 by, for example, welding. To this end, locking arms 38 can be fabricated having differing lengths (as indicated at $l_{38}$) to accommodate coils C having differing depths D.

A thrust lever 48 is mounted to the second flange arm 36 and includes a camming element, formed as a bearing arm 50 and a lever arm 52 mounted to one another. The bearing arm 50 and lever arm 52 are mounted to one another at an obtuse angle $\alpha$. Preferably, the angle a is about 100 degrees. The bearing arm 50 is mounted to the second flange arm 36 for pivoting movement about a pivot, indicated generally at 51. The thrust lever 48 is pivotable between a first position wherein the bearing arm 50 is essentially vertical and a second position wherein the lever arm 52 is essentially horizontal. Thus, the thrust lever 48 is pivotable about 10 degrees. A handle 54 extends from an end of the lever arm 52 to provide a gripping region for an operator. In a current embodiment, the lever arm 52 is formed from a steel bar and the bearing arm 50 is formed from a pair of bars mounted to either side of the lever arm 52 in a sandwich arrangement. A stop 56 is mounted to an upper portion of the second flange arm 36 to limit the range that the lever arm 52 pivots from the horizontal.

The manipulating assembly 12 is configured and dimensioned for a specific size coil C. To this end, the manipulating assembly 12 is configured for use with a coil C having a specific inside diameter ID and a specific depth D. As such, the locking arm 38 has a length $l_{38}$ to the locking projection or hook 44 that is about equal to the depth D of the coil C. In this manner, when the coil C is engaged with the locking arm 38 a bottom edge at the inside surface I of the coil C will rest against the locking arm 38 at the juncture of the engaging surface 42 and the projection 44.

Figure 10A:
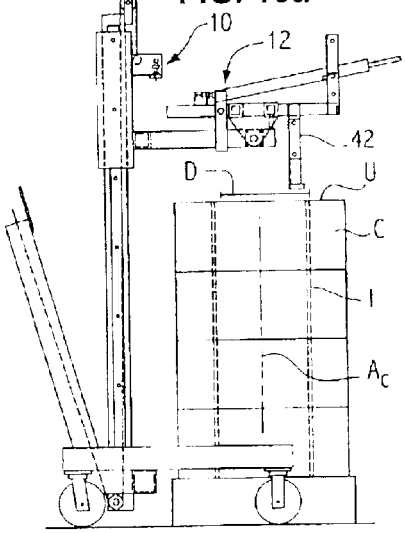
FIGS. 10*a*–10*g* are illustrations of the device in use.

The thrust lever 48 is configured so that when it is in the non-engaging position (FIG. 10*b*), that is with the bearing arm 50 in a vertical orientation, the distance between a bearing surface 58 of the arm 50 and the projection 44 is sufficient to allow the manipulating assembly 12 to be inserted into the coil C. The thrust lever 48 is further configured so that when the lever arm 52 is moved downwardly to the horizontal (as seen in FIG. 10*c*, which moves the bearing arm 50 out of the vertical) the distance between the locking arm engaging surface 42 arm and the bearing arm bearing surface 58, at its greatest, is about equal to the inside diameter ID of the coil C.

Referring again to FIGS. 3–7, a positioning member 60 extends upwardly from the first flange arm 34 at about an end thereof, opposite of the locking arm 38. The positioning member 60 includes a plurality of openings 62*a,b,c* therein, some of which (62*a,b*) are configured to cooperate with an opening 64 in the lever arm 52. In a current embodiment, the positioning member 60 is formed from a pair of steel bars mounted on either side of the first flange arm 34 in a sandwich arrangement. The lever arm 52 is positioned to move between the bars the form the positioning member. The lever arm and positioning member openings 64 and 62*a,b* align with one another and are configured to receive a pin 66 to lock the thrust lever 48 in one of a plurality of desired positions.

The manipulating assembly 12 is mounted to the lifting assembly 14. In the illustrated embodiment, the lifting assembly 14 includes a simple boom-type lifting arrangement. A lift carriage 68 rides along a vertically oriented boom 70, and is moved up and down by a cable 72 that is fixedly mounted to the carriage 68 that is positioned around one or more pulleys 74 and operably connected to a drive (not shown) such as an electric motor, a hand operated winch or the like. Those skilled in the art will recognize the various types of drives that can be used for such a boom-type lifting device. The manipulating assembly 12 is mounted to the lifting assembly 14 to raise and lower the manipulating assembly 12.

The transport assembly 16 is configured to carry the lifting assembly 14 and the manipulating assembly 12. The transport assembly 16 includes a base 76 and a plurality of casters or wheels 78 mounted to the base 76. In a present configuration, four wheels 78*a–d* are mounted to the base 76 for transporting the coil handling device 10. Referring to FIGS. 1–2, the transport assembly 16 includes a pair of wheels 78*a,b* that are mounted at a rear end 80 of the assembly 16. These wheels 78*a,b* are outside of the "envelope" of the manipulating assembly 12 and lifting assembly 14. To this end, these wheels 78*a,b* are configured in a position to provide maximum support to the coil handling device 10 and maneuverability. The front wheels 78*c,d* are located under the manipulating assembly 12 when in use.

The transport assembly 16 can be configured having first and second longitudinally oriented support members 82 from which the wheels or casters 78*c,d* depend. The support members 82 are sufficiently spaced from one another so that a coil C that is positioned in a singular stack on a pallet P can be engaged by approaching any of the flat side of the pallet P as seen in FIGS. 1–2.

Figure 8:
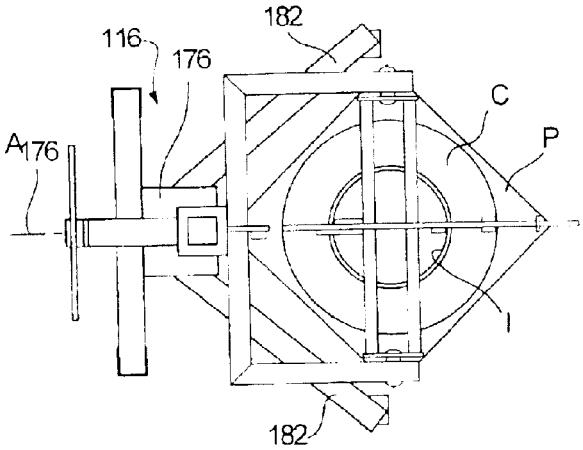
FIG. 8 is a top view of an embodiment of the coil handling device having a transport assembly with angled caster supports, the device shown straddling the corner of a pallet having a single layer of coils thereon.
Figure 9:
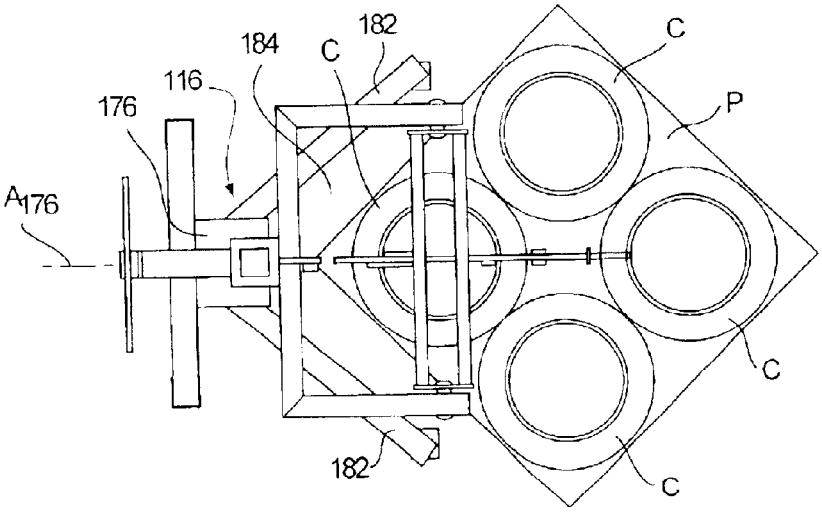
FIG. 9 is a top view of the coil handling device of FIG. 8 shown straddling the comer of a pallet having four coils per layer of coils.

In an alternate embodiment of the transport assembly 116, as seen in FIGS. 8–9, a pair of angled wheel or caster arms 182 extend from the base 176. The caster arms 182 are configured to provide an angled region therebetween as indicated at 184. To this end, the caster arms 182 each extend from the base 176 at about 45 degrees to an axis $A_{176}$ of the base 176. As will be readily apparent from FIG. 8, the caster arms 182 are positioned at this angle so that access to a coil C can be made at an angle to, i.e., from a comer of, a pallet P on which the coil C is stacked. In this manner, there is no support structure of the transport assembly 116 that interferes with approaching the pallet P to engage and lock a coil C to the device 10. Again, as will be apparent, this angled caster arm 182 arrangement permits use of the handling device 10 when the coils C are stacked singly on a pallet P (FIG. 8), or as anticipated for certain types of coils C (and a shown in FIG. 9), in an arrangement in which the coils C are stacked in multiples in a single layer or multiple layers on a pallet P.

Operation of the coil handling device 10 will now be described with reference to FIGS. 10*a* through 10*g*. Referring to FIG. 10*a*, the coil handling device 10 is moved into position immediately above a coil C that is positioned with its longitudinal axis $A_c$ vertically oriented. The device 10 is positioned with the manipulating assembly 12 elevated over the center of the coil C.

Figure 10B:
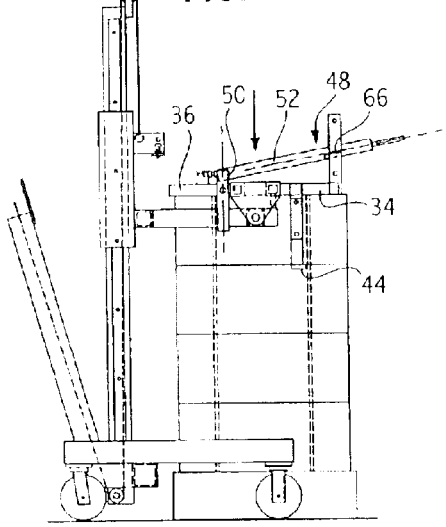
Figure 10C:
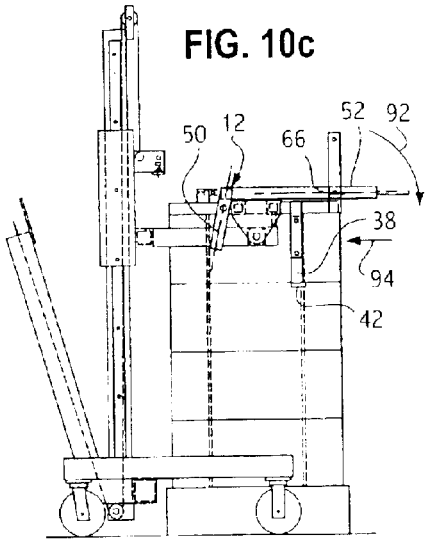

As shown in FIG. 10*b*, the manipulating device 12 is then lowered into the center of the coil C so that the first and second flange arms 34, 36 rest on an upper surface U of the coil C. In this pre-engaged configuration, the bearing arm 50 is positioned vertically and the lever arm 52 is positioned at an angle to the horizontal. The pin 66 can be inserted through corresponding openings 64, 62*b* in the lever arm 52 and positioning member 60 to lock the thrust lever 48 in this pre-engaged position. As set forth above, the distance d (FIG. 10*a*) between the projection or hook 44 and the bearing arm 50 is sufficient to permit the manipulating assembly 12 to be "dropped" into the center of the coil C.

Referring now to FIG. 10*c*, once the manipulating assembly 12 is properly positioned within the coil C, the pin 66 is removed and the lever arm 52 is urged downwardly, as indicated by the arrow at 92. As the lever arm 52 is urged downwardly, the bearing arm 50 pushes against an inside surface I of the coil C. This moves the coil C off-center of the coil stack S (as indicated by the arrow at 94), and so that the inside surface I of the coil C abuts the engaging surface 42 of the locking arm 38 and is positioned above the locking arm projection 44. At the same time, the bearing arm 50 is urged against the inside surface I of the coil C, 180° from the engaging surface 42, which "locks" the coil C between the bearing arm 50 and the locking arm 38. When in this position, the lever arm 52 is in a horizontal orientation. The pin 66 is then inserted through the appropriate openings 64, 62*a* in the positioning member 60 and the lever arm 52 to lock the manipulating assembly 12 in this engaged position.

Figure 10D:
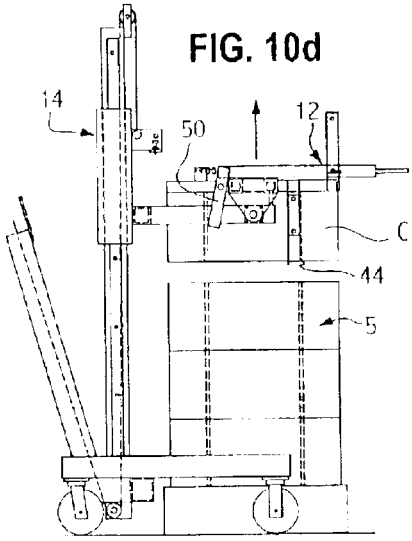
Figure 10E:
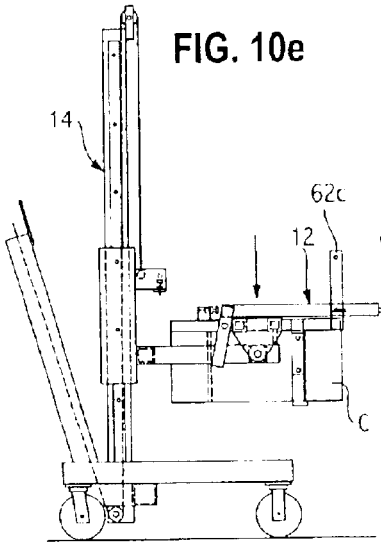
Figure 10F:
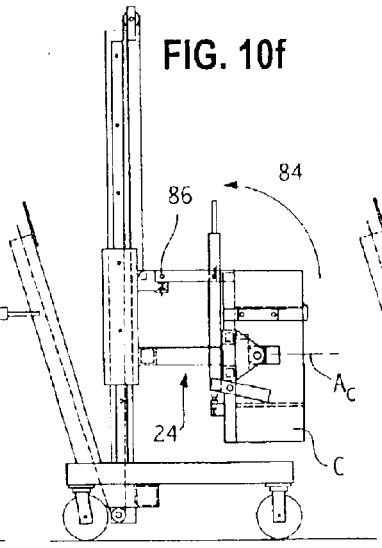

As illustrated in FIG. 10*d*, with the coil C fully engaged by and locked onto the manipulating assembly 12, the lifting assembly 14 is actuated to elevate the coil C. Once the coil C is elevated, if necessary, it can be cleared from the remaining coils in the stack S. The coil C can then be lowered as seen in FIG. 10*e*. Referring now to FIG. 10*f*, the manipulating assembly 12 is pivoted or rotated at the carriage 24, 90 degrees, as indicated by the arrow at 84, to reorient the coil C such that the longitudinal axis $A_c$ is horizontal. Once the coil C is reoriented to this horizontal orientation, the manipulating assembly 12 is then locked into this orientation, such as by inserting a pin 86 through a lift lock 88 and the opening 62*c* formed in the positioning member 60. Alternately, a spring-action type lock, illustrated generally at 90 can be used to lock the lift lock 88 and positioning member 60 to one another. Such spring-action type locks 90 will be recognized by those skilled in the art. In this manner, the coil C is secured to the coil handling device 10 and can be transported.

Figure 10G:
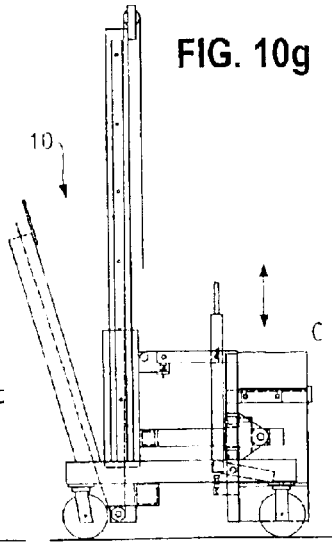

As shown in FIG. 10*g*, once in this position, the coil C can be raised or lowered as necessary for positioning the coil C onto a strapping machine. As set forth above, strapping machines generally require that the coil C be positioned on the machine with the longitudinal axis $A_c$ horizontally oriented. This permits rotation of the coil C so that the strap can freely feed therefrom.

Figure 11A:
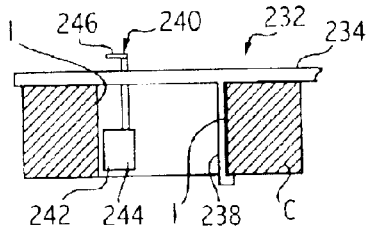
FIGS. 11*a,b*–14*a,b* illustrate alternate embodiments of the coil handling device locking assembly.

Alternate embodiments of the locking assembly are shown in FIGS. 11*a,b* through 14*a,b*. Referring to FIGS. 11*a,b*, the locking assembly 232 includes a locking arm 238 and a bearing assembly 240 that are mounted to a flange arm 234. The bearing assembly 240 includes a rotating camming element that is formed as a bearing element 242. The locking arm 238 engages the inner surface I of the coil C and the bearing element 242 bears against an inner surface I of the coil C opposite to the locking arm 238. The bearing element 242 can be formed as a drum or other camming type arrangement. As illustrated, the camming arrangement includes a camming drum 244 and a lever arm that is formed as a handle 246 that is eccentrically positioned on or mounted to the drum 244 for rotation.

Figure 12A:
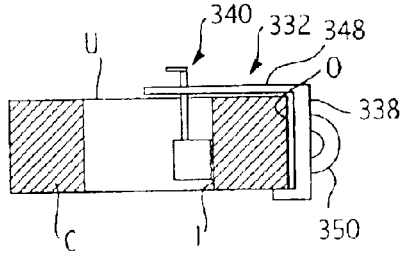
Figure 11B:
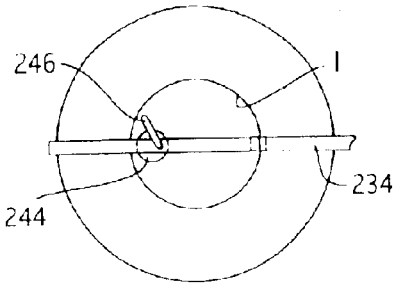
Figure 12B:
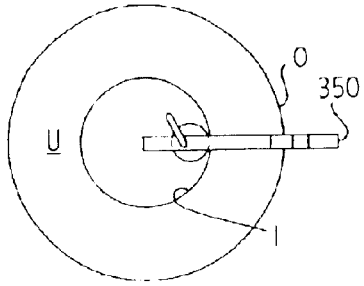

FIGS. 12*a,b* illustrate a locking assembly 332 in which the bearing assembly 340 is similar to that shown in FIGS. 11*a,b*. In this embodiment, the locking arm 338 engages an outer surface O of the coil C, while the bearing assembly 340 engages the inner surface I of the coil C radially inward of the locking arm 338. The locking arm 338 includes an elongated upper support portion 348 that extends along an upper surface U of the coil C for support. The locking arm 338 can include a clevis-type mount 350 for mounting to the lifting assembly 14.

Figure 13A:
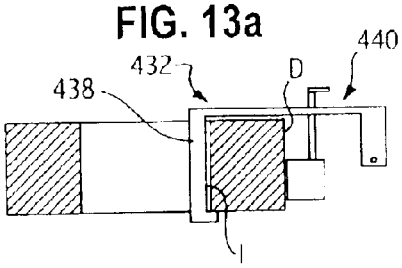

The embodiment 432 illustrated in FIGS. 13*a,b* shares many of the features with the embodiment 332 of FIGS. 12*a,b*. In this embodiment, however, the locking arm 438 is again configured for engaging the inner surface I of the coil C and the bearing assembly 440 is configured for engaging the outer surface O of the coil C.

Figure 14A:
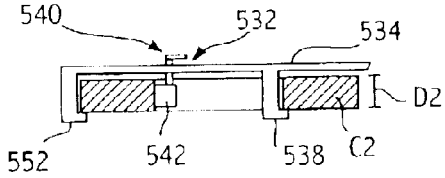
Figure 13B:
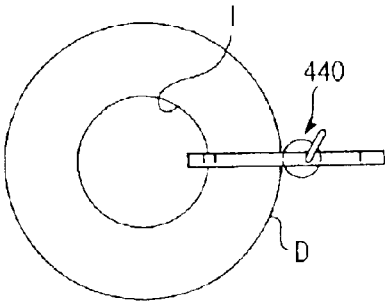
Figure 14B:
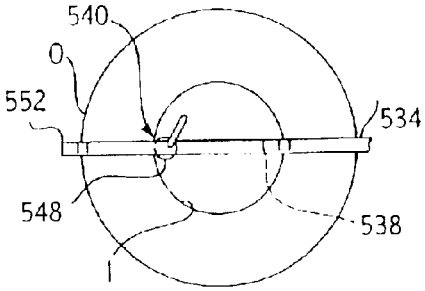

For use with coils C2 having a smaller depth D2, the embodiment 532 of FIGS. 14*a,b* can be used. In this arrangement, the locking arm 538 and a bearing assembly 540 are again mounted to a flange arm 534. A second locking arm 552 is positioned to engage the outer surface O of the coil C2 opposite the bearing assembly 540. In this embodiment, the bearing assembly 540 also includes a rotating bearing element 542. The locking arm 538 engages the inner surface I of the coil C and the bearing element 542 bears against an inner surface I of the coil C opposite of the locking arm 538. The second locking arm 552 engages the outer surface O of the coil C opposite the bearing element 542.

Other alternate locking assemblies, as well as manipulating assemblies, lift assemblies and transport assemblies will be appreciated by those skilled in the art after a study of the present disclosure and the accompanying drawings. All such alternate embodiments are within the scope and spirit of the present invention.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A coil manipulating device for engaging a coil having a depth, an upper surface and an Interior surface defining a diameter, the coil defining a longitudinal axis perpendicular to the upper surface, the coil handling device configured to engage the coil with the longitudinal axis oriented vertically and reorient the coil to position the longitudinal axis horizontally, the manipulating device comprising:

a support; and a pivoting carriage carried by the support, the carriage including a locking arm for engaging a surface of the coil along the depth of the coil, the carriage further including a camming element and a lever arm operably connected thereto for moving the camming element, the camming element being movable, by movement of the lever arm between a first position wherein the locking arm and camming element the coil and a second position wherein the camming element is urged against the coil to lock the coil between the locking arm and the camming element, the pivoting carriage being pivotable between a first position in which the coil longitudinal axis is vertical and a second position in which the coil longitudinal axis is horizontal, wherein the camming element is formed as a rotating camming drum, and the lever arm is formed as a handle for rotating the camming drum.

2. The coil manipulating device in accordance with claim 1 wherein the locking arm engages an interior surface of the coil and the camming element bears against an inner surface of the coil opposite the locking arm.

3. The coil manipulating device in accordance with claim 1 wherein the locking arm is configured for engaging the interior surface of the coil and the camming element is configured for engaging an outer surface of the coil.

4. A coil manipulating device for engaging a coil having a depth, an upper surface and an interior surface defining a diameter, the coil defining a longitudinal axis perpendicular to the upper surface, the coil handling device configured to engage the coil with the longitudinal axis oriented vertically and reorient the coil to position the longitudinal axis horizontally, the manipulating device comprising:

a support; and a pivoting carriage carried by the support, the carriage including a locking arm for engaging a surface of the coil along the depth of the coil, the carriage further including a camming element and a lever arm operably connected thereto for moving the camming element, the camming element being movable, by movement of the lever arm, between a first position wherein the locking arm and camming element engage the coil and a second position wherein the camming element is urged against the coil to lock the coil between the locking arm and the camming element the pivoting carriage being pivotable between a first position in which the coil longitudinal axis is vertical and a second position in which the coil longitudinal axis is horizontal, wherein the locking arm engages an outer surface of the coil and the camming element engages the interior surface of the coil radially inward of the locking arm, and wherein the locking arm includes an elongated upper support portion that extends along the upper surface of the coil.

5. The coil manipulating device in accordance with claim 4 wherein the locking arm engages an interior surface of the coil and the camming element bears against inner surface of the coil opposite the locking arm.

6. The coil manipulating device in accordance with claim 4 wherein the locking arm is configured for engaging the interior surface of the coil and the camming element is configured for engaging an outer surface of the coil.

7. A coil manipulating device for engaging a coil having a depth, an upper surface and an interior surface defining a diameter, the coil defining a longitudinal axis perpendicular to the upper surface, the coil handling device configured to engage the coil with the longitudinal axis oriented vertically and reorient the coil to position the longitudinal axis horizontally, the manipulating device comprising:

a support; and a pivoting carriage carried by the support the carriage including a locking arm for engaging a surface of the coil along the depth of the coil, the carriage further including a camming element and a lever arm operably connected thereto for moving the camming element the camming element being movable, by movement of the lever arm, between a first position wherein the locking arm and camming element engage the coil and a second position wherein the camming element is urged against the coil to lock the coil between the locking arm and the camming element, the pivoting carriage being pivotable between a first position in which the coil longitudinal axis is vertical and a second position in which the coil longitudinal axis is horizontal, including a flange arm, wherein the locking arm and the camming element are mounted to the flange arm, and including a second locking arm, wherein the locking arm engages the interior surface of the coil and the camming element bears against an interior surface of the coil opposite of the locking arm, and wherein the second locking arm engages the outer surface of the coil opposite the camming element.

8. The coil manipulating device in accordance with claim 7 wherein the locking arm engages an interior surface of the coil and the camming element bears against an inner surface of the coil opposite the locking arm.

9. The coil manipulating device in accordance with claim 7 wherein the locking arm is configured for engaging the interior surface of the coil and the camming element is configured for engaging an outer surface of the coil.

* * * * *

UNITED STATES PATENT AND TRADEMARK OFFICE

CERTIFICATE OF CORRECTION

PATENT NO. : 6,817,826 B2
DATED : November 16, 2004
INVENTOR(S) : Bullington et al.

It is certified that error appears in the above-identified patent and that said Letters Patent is hereby corrected as shown below:

Column 8,
Line 53, should read -- ...locking arm and camming element engage the coil and a… --.

Signed and Sealed this

Thirtieth Day of August, 2005

JON W. DUDAS
*Director of the United States Patent and Trademark Office*